US007188495B2

(12) United States Patent
Errani et al.

(10) Patent No.: US 7,188,495 B2
(45) Date of Patent: Mar. 13, 2007

(54) ELECTRIC LOCK WITH MAGNETIC SUPPORT OF THE COUPLING ELEMENT

(75) Inventors: Deo Errani, Faenza (IT); Luciano Darchini, Faenza (IT)

(73) Assignee: Cisa S.p.A., Bologna (IT)

( * ) Notice: Subject to any disclaimer, the term of this patent is extended or adjusted under 35 U.S.C. 154(b) by 67 days.

(21) Appl. No.: 10/959,090

(22) Filed: Oct. 7, 2004

(65) Prior Publication Data

US 2005/0092046 A1 May 5, 2005

(30) Foreign Application Priority Data

Oct. 10, 2003 (IT) ..... BO2003A0583

(51) Int. Cl.
*E05B 49/00* (2006.01)
*E05B 55/04* (2006.01)

(52) U.S. Cl. ..... 70/278.7; 70/218; 70/222; 70/276; 70/467

(58) Field of Classification Search ..... 70/209, 70/210, 215, 224, 276, 277, 278.1, 278.7, 70/279.1, 280–282, 149, 218, 222, 283, 422; 292/251.5, DIG. 27
See application file for complete search history.

(56) References Cited

U.S. PATENT DOCUMENTS 4,820,330 A * 4/1989 Lin ..... 70/277
5,027,629 A * 7/1991 Liu ..... 70/277
5,475,996 A * 12/1995 Chen ..... 70/279.1
5,862,903 A * 1/1999 Gruden et al. ..... 70/276
6,427,505 B2 * 8/2002 Imedio Ocana ..... 70/278.7
6,640,594 B1 * 11/2003 Yao ..... 70/277
6,647,753 B2 * 11/2003 Engler ..... 70/277
6,851,291 B2 * 2/2005 Nunez ..... 70/283
2001/0003913 A1 6/2001 Engler
2002/0056300 A1 5/2002 Messier et al.
2003/0110819 A1 * 6/2003 Sadler ..... 70/210
2006/0196238 A1 * 9/2006 Avni ..... 70/218

FOREIGN PATENT DOCUMENTS

WO 91/12400 A 8/1991
WO 91/16517 A 10/1991

* cited by examiner

*Primary Examiner*—Suzanne Dino Barrett
*Assistant Examiner*—Christopher Boswell
(74) *Attorney, Agent, or Firm*—Modiano & Associati; Albert Josif; Daniel O'Byrne

(57) ABSTRACT

An electric lock with magnetic support of the coupling element, comprising a locking element engaging a selvage, a decoding assembly for a code bearing component, an actuation element, connected to an internal handle and associated with the locking element, and a second actuation element, connected to an external handle and coupled to the locking element by way of an electromechanical device. The actuation element comprises a stem connected to the external handle with a rotating plate and a contrast plate, at an end resting freely on a rotatable sleeve, coupled to the locking element and provided with notches; an electric motor and a slider, aligned with the notches actuatable to perform translational motion, and a magnet supporting a coupling element adapted to enter the notches to rigidly couple to each other the plate, the contrast plate and the sleeve.

11 Claims, 5 Drawing Sheets

ELECTRIC LOCK WITH MAGNETIC SUPPORT OF THE COUPLING ELEMENT

The present invention relates to an electric lock with magnetic support of the coupling element.

BACKGROUND OF THE INVENTION

Electrically operated locks suitable to be applied to doors for accessing spaces such as rooms, offices and apartments use a component that is provided with a code as an access key.

This component is generally a card that can contain a microprocessor or can be provided with a magnetic strip: in any case, its purpose is to store a code that is correlated to the lock to be operated.

The door protected with this type of lock generally has an internal handle (or knob), which acts directly on the locking element of the lock, always allowing to open said lock from the inside.

For access from the outside, it is necessary to insert the card in an appropriately provided reader (or, more generally, to insert the component in an appropriately provided receptacle of a respective decoding assembly), which enables a handle (or knob), located on the outside of the door, to move the locking element.

The apparatuses normally used to enable opening when the lock has received the correct access code are constituted by a plurality of components: the high complexity of the apparatus makes malfunctions more likely, and said malfunctions moreover entail high maintenance costs, indeed because of the need to disassemble and reassemble the many parts, which are often small.

SUMMARY OF THE INVENTION

The aim of the present invention is to obviate the above-mentioned drawbacks and to meet the mentioned requirements, by providing an electric lock with magnetic support of the coupling element that is constituted by a small number of simple elements, which can be easily operated manually in case of failure of the electric power supply.

Within this aim, an object of the present invention is to provide an electric lock that is simple, relatively easy to provide in practice, safe in use, effective in operation, and has a relatively low cost.

This aim and this and other objects that will become better apparent hereinafter are achieved by the present electric lock with magnetic support of the coupling element, of the type that comprises a locking element that engages in a respective selvage of the jamb, a decoding assembly adapted to accommodate a component that bears a code, a first actuation element, which is connected to an internal handle and is directly associated with said locking element, and a second actuation element, which is connected to an external handle and is coupled to said locking element by means of an electromechanical device, characterized in that said second actuation element comprises, rigidly coupled to said external handle, a protruding stem that ends with a rotating plate and a contrast plate, which is likewise rotatable and rests freely on a sleeve, which is likewise rotatable but is rigidly coupled to said locking element, said plate, said contrast plate and said sleeve being provided with respective notches, and in that said electromechanical device is constituted by an electric motor and by a slider, which is aligned with said notches and can be actuated so as to perform a translational motion indirectly by said motor, said slider being provided on its head with a magnet for supporting a coupling element that is adapted to enter said notches when the slider is in the forward position, in order to rigidly couple to each other said plate, said contrast plate and said sleeve.

BRIEF DESCRIPTION OF THE DRAWINGS

Further characteristics and advantages of the present invention will become better apparent from the following detailed description of a preferred but not exclusive embodiment of an electric lock with magnetic support of the coupling element, illustrated by way of non-limiting example in the accompanying drawings, wherein.

DESCRIPTION OF THE PREFERRED EMBODIMENTS

Figure 1:
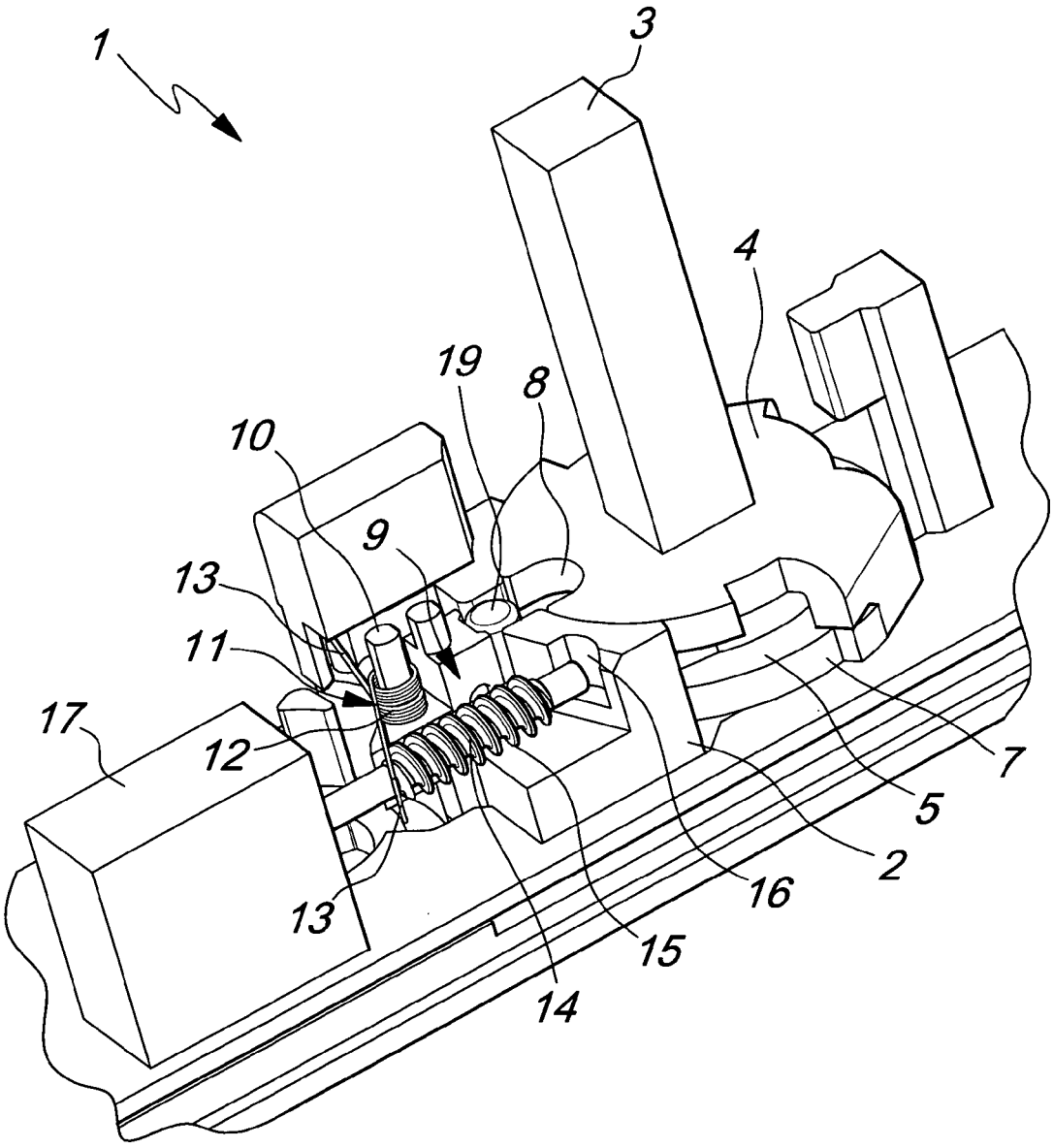
FIG. 1 is a perspective view of a lock according to the invention.
Figure 2:
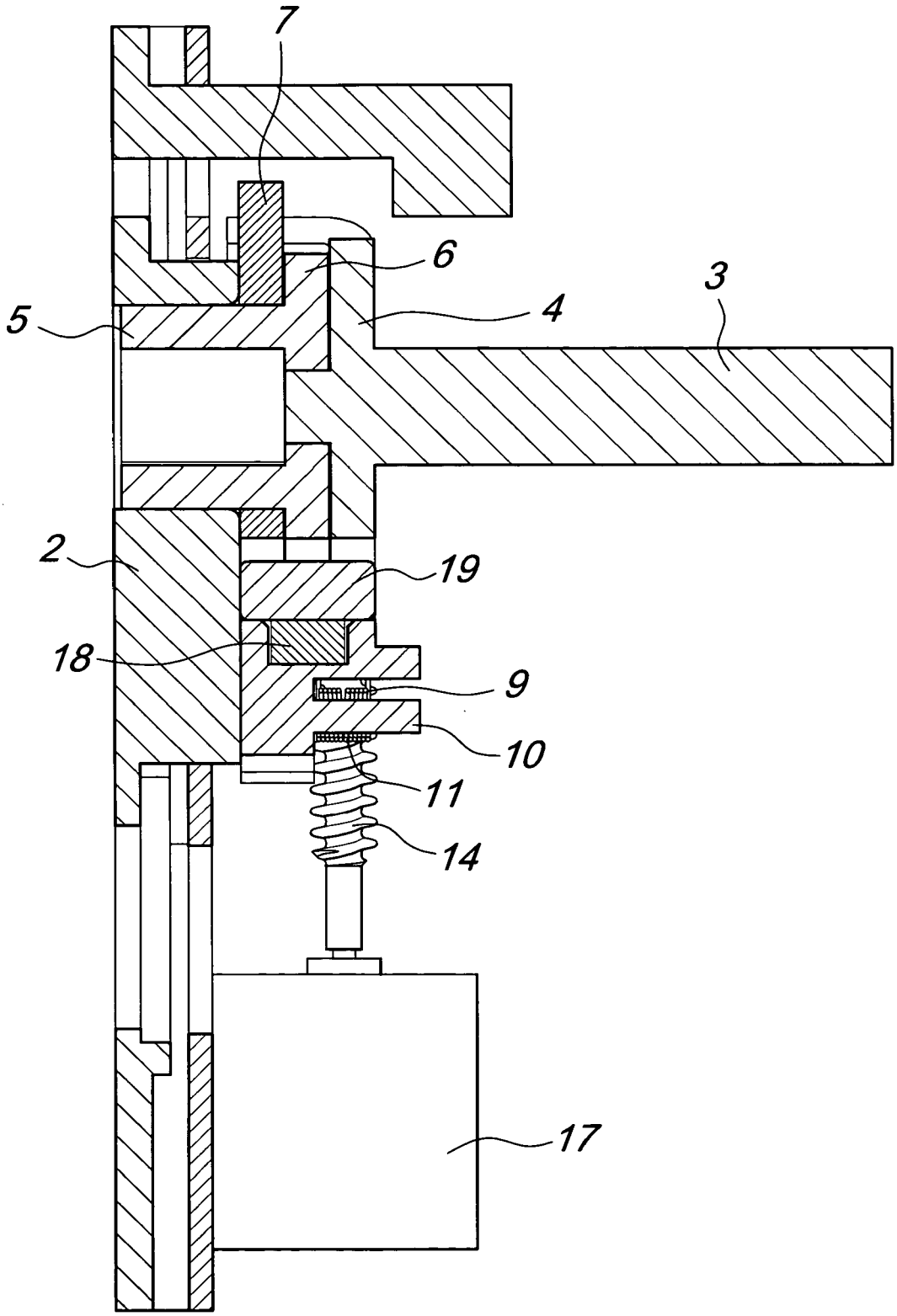
FIG. 2 is a sectional view, taken along a longitudinal plane that passes through the axis of the stem, of a lock according to the invention.

With reference to the figures, the reference numeral 1 generally designates an electric lock with magnetic support of the coupling element.

Each lock 1 is constituted by a fixed body 2, from which a stem 3 protrudes outward (the knob or handle for opening from the outside is connected to said stem). The stem 3 has, at its base, a plate 4, which can rotate on a sleeve 5, the upper edge 6 of which rests on a contrast plate 7. The sleeve 5 is associated with the locking element, not shown in the figure, and therefore a rotation thereof entails a corresponding retraction (or protrusion) of said locking element; the sleeve 5 is constantly associated with the internal handle.

The plate 4, the contrast plate 7 and the sleeve 5 have respective notches 8, which are substantially shaped in a similar manner.

With respect to the assembly configuration, a slider 9 is located below the plate 4 and the sleeve 5, can slide on a respective linear guide, and is provided with a cylindrical pin 10 that is substantially parallel to the axis of the stem 3.

A spring 11 is constituted by a central portion 12, which forms a cylindrical winding of metal turns, and by two linear arms 13. The central portion 12 is fitted on the pin 10 and covers it completely, while the two arms 13 are respectively coupled within a fixed part of the body 2 and engaged on a worm screw 14, between two successive crests 15.

The worm screw 14 is arranged laterally with respect to the slider 9 and is parallel to the linear guide of the slider 9; a first end of the worm screw rests in a fixed seat 16 of the body 2 and a second end is rigidly coupled to the shaft of an electric motor 17.

A magnet 18 is fixed to the upper end of the slider 9 and is designed to retain a roller 19 by magnetic attraction in close contact with the slider 9.

Figure 3:
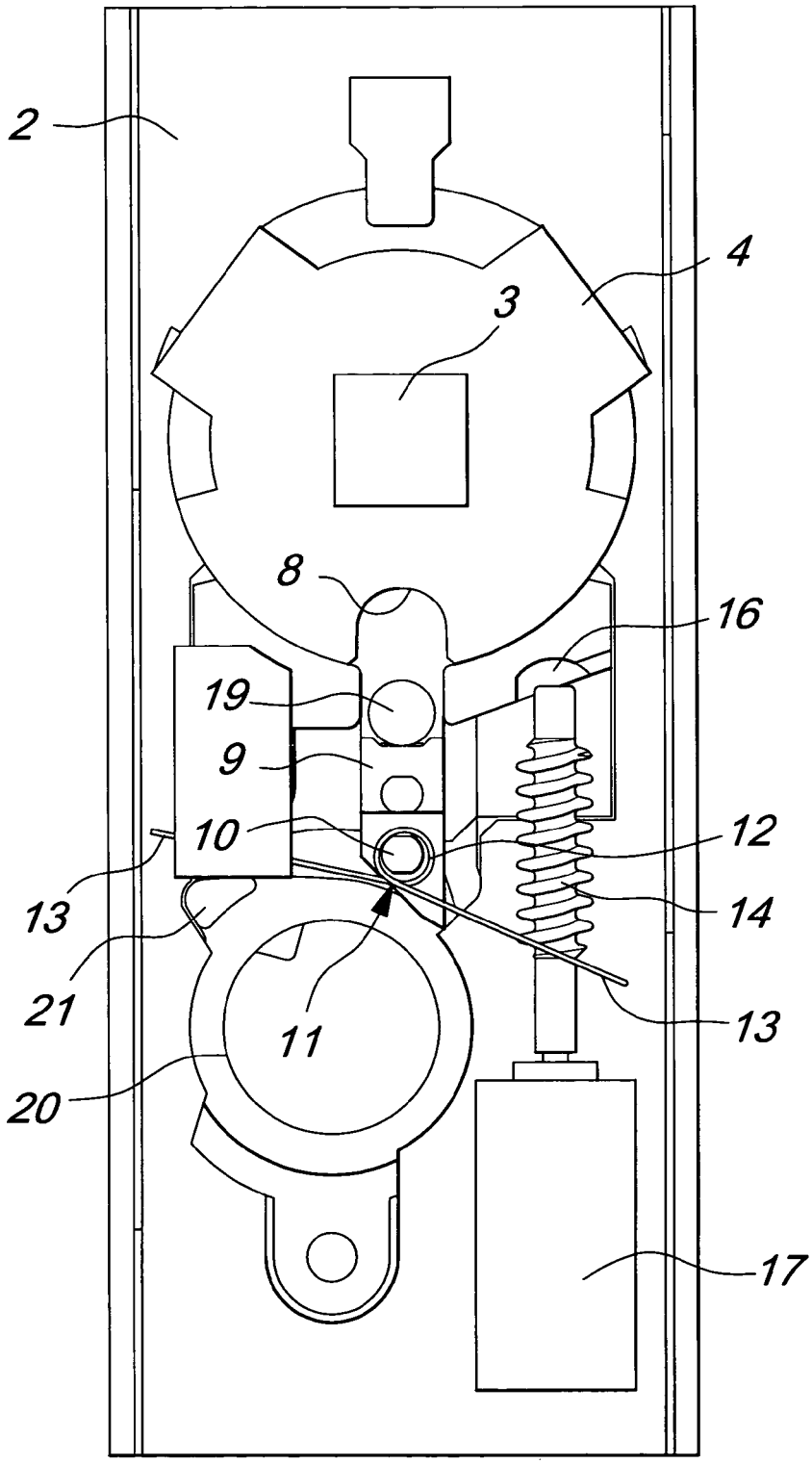
FIG. 3 is a front view of a lock according to the invention in the closure position.

The operation of the invention is as follows: when the lock 1 is closed, the stem 3 is free, and therefore any rotation thereof imparted by a rotation of the knob (or handle) entails no motion and therefore no direct forcing of the locking element (situation shown in FIG. 3).

Figure 4:
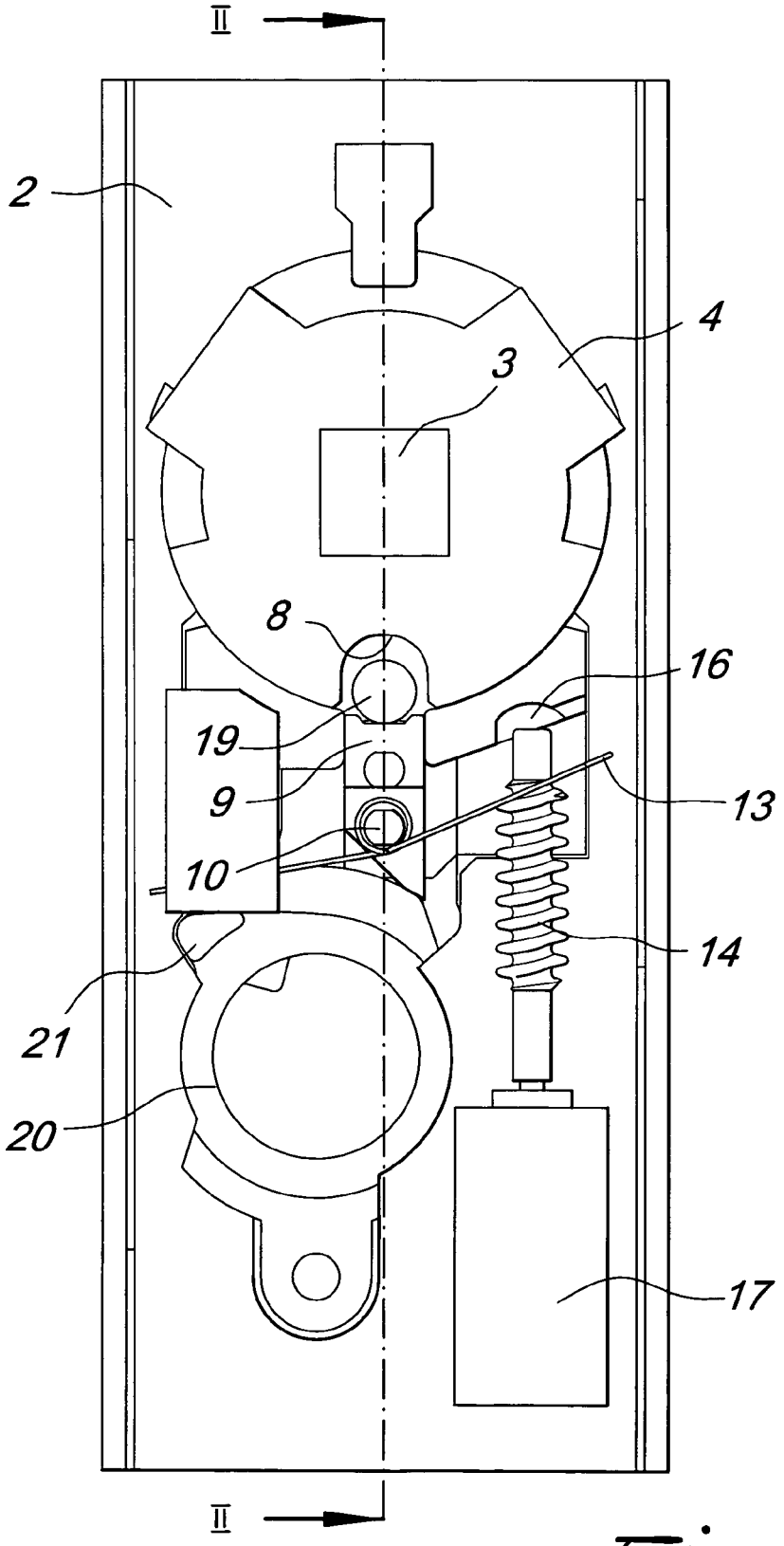
FIG. 4 is a front view of a lock according to the invention in the electric opening position.

As a consequence of the insertion of the component provided with a code (generally a card with a magnetic strip or provided with an integrated memory circuit) in an appropriately provided receptacle of the decoding assembly (generally a card reader), and if the code is the one enabled for opening, the motor 17 is supplied with power so that it turns the worm screw 14. The arm 13, arranged between two successive crests 15 of the worm screw 14, is transferred from the configuration shown in FIG. 3 (arm 13 proximate to the motor 17) to the configuration shown in FIG. 4 (arm 13 proximate to the fixed seat 16).

During this motion of the arm 13, the slider 9 is subjected to a translational motion that causes its upper end (the one that accommodates the magnet 18) to face the plate 4 and the sleeve 5. In this configuration, the roller 19 (which constitutes the coupling element) is accommodated within the notches 8 of the plate 4, of the contrast plate 7 and of the sleeve 5, which are mutually superimposed.

The presence of the roller 19 in this position entails that said roller rigidly couples the plate 4, the contrast plate 7 and the sleeve 5 to each other: in this configuration (FIG. 4), a rotation of the outer knob (or handle), which induces a similar rotation of the stem 3, of the plate 4 and of the contrast plate 7, also rotates the sleeve 5, entailing the actuation of the locking element and therefore the opening of the lock 1. Rotation is allowed thanks to the fact that the connection between the slider 9 and the roller 19 occurs by means of the magnet 18: the rotation of the stem 3 in fact entails the rotation of the sleeve 5 (and therefore a movement of the locking element), indeed in relation to the fact that the roller 19 is free to move while keeping them mutually rigidly coupled. Once the lock 1 has opened, the handle is released and therefore the plate 4 and the sleeve 5 return to the initial position (in which the notches 8 face the slider 9), and the roller 19, by magnetic attraction, returns to being supported by the magnet 18 so as to adhere to the surface of the slider 9.

If it is necessary to open the lock 1, in case of an electric power supply failure, it is necessary to access a bit 20, which is located below the slider 9.

Figure 5:
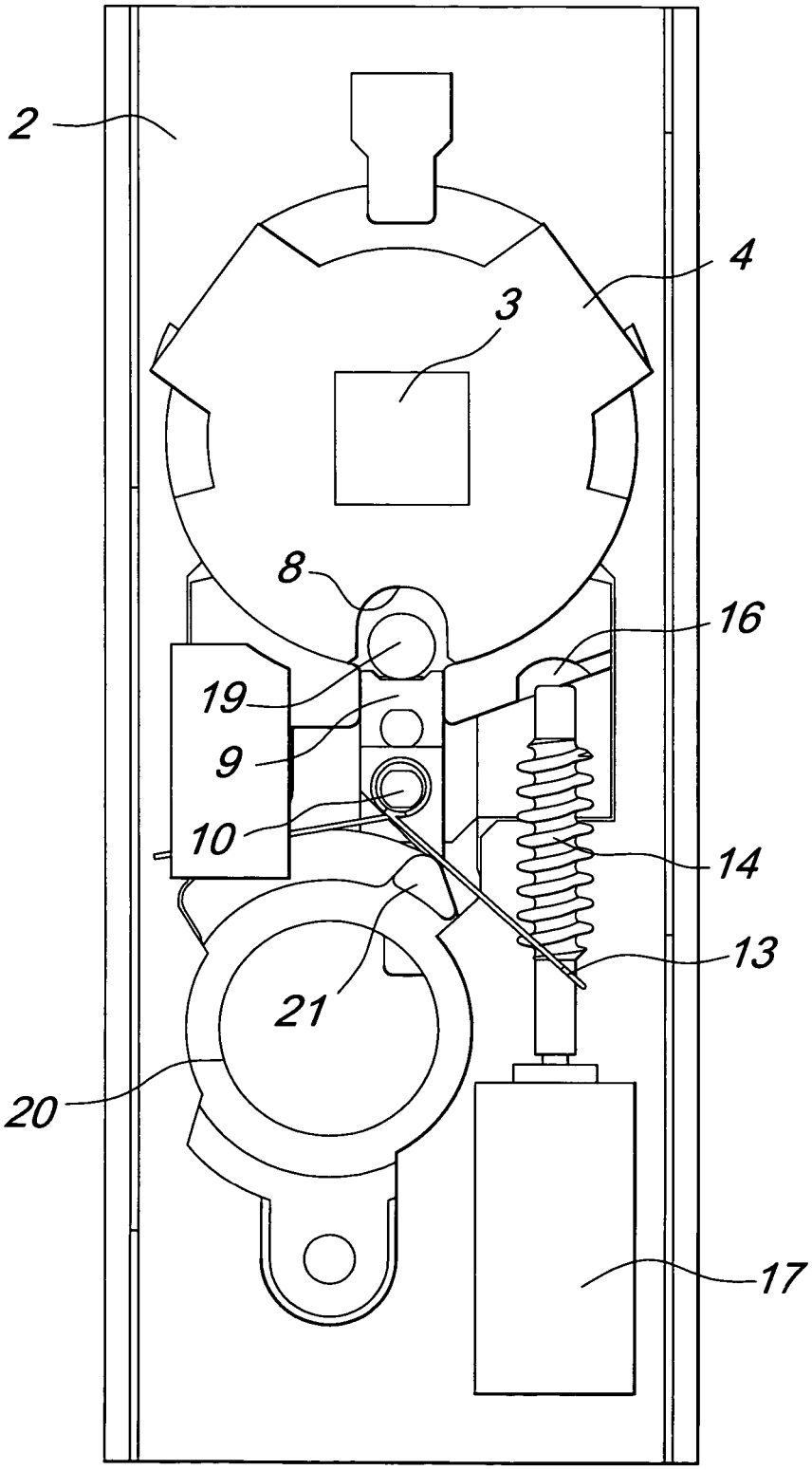
FIG. 5 is a front view of a lock according to the invention in the emergency manual opening position.

Access may be possible only by having an appropriately provided key, by means of which it is possible to turn the bit 20, with a consequent action of the inclined surface 21 on the lower surface of the slider 9 that entails an upward translational motion of the slider 9 (as shown in FIG. 5).

The spring 11 undergoes a deformation, reducing the angle between its two arms 13 (because the arm 13 remains engaged in the worm screw 14 proximate to the motor 17), tending to return the slider 9 downward (return translational motion prevented by the presence of the inclined surface 21).

The upward translational motion of the slider 9 entails the engagement of the roller 19 in the notches 8 and therefore allows actuation of the locking element by means of the knob (or handle) fitted on the stem 3.

By returning the bit 20 to its initial configuration, the slider 9 again performs a downward translational motion by way of the action of the spring 11, and the-rotation of the stem 3 is again independent of the rotation of the sleeve 5.

The locking element is obviously usually the latch of the lock 1.

It has thus been shown that the invention achieves the intended aim and object.

The invention thus conceived is susceptible of numerous modifications and variations, all of which are within the scope of the appended claims.

All the details may further be replaced with other technically equivalent ones.

In the embodiments shown, individual characteristics, given in relation to specific examples, may actually be interchanged with other different characteristics that exist in other embodiments.

Moreover, it is noted that anything found to be already known is understood not to be comprised within the scope of the appended claims and to be the subject of a disclaimer.

In practice, the materials used, as well as the shapes and dimensions, may be any according to requirements without thereby abandoning the scope of the protection of the appended claims.

The disclosures in Italian Patent Application No. BO2003A000583 from which this application claims priority are incorporated herein by reference.

What is claimed is:

1. An electric lock with a magnetic support for a coupling element comprising:

a first internal-handle actuation element comprising a rotable sleeve;

an electromechanical device;

a second external-handle actuation element connected to said of said comprising a protruding stem the, a rotating plate; and a contrast plate that rests freely movable on said sleeve;

wherein said rotatable plate, said contrast plate and said sleeve being rotatable and being provided with respective notches; and wherein said electromechanical device is constituted by an electric motor and by a slider aligned with said notches and actuatable by said motor so as to perform a translational motion, said slider being provided at a head thereof with a magnet and with a coupling element supported at said magnet and adapted to enter said notches when said slider is in a forward actuation position, in order to jointly couple to each other said rotatable plate, said contrast plate and said sleeve, said coupling element being constituted by a roller, and the lock further comprising a guide, said slider being fitted so as to be slideable within said guide, to perform a translational motion from a first configuration, in which the roller supported by the mannet is completely external to said notches of the plate, of the contrast plate and of the sleeve, to a second configuration, in which said roller is accommodated within said notches, rigidly coupling the plate, the contrast plate and the sleeve to each other.

2. The lock of claim 1, wherein said motor comprises a shaft and a worm screw fitted on said shaft and a spring with linear arms, said slider being associated with said worm screw by way of said spring with linear arms.

3. The lock of claim 2, comprising a fixed seat provided at said body, said second configuration of said slider corresponding to an arrangement in which an arm of said spring is engaged on the worm screw, said arrangement being achieved by way of rotation of the shaft of the motor, and of said worm screw, between two end crests of said worm screw that are closest to said fixed seat.

4. The lock of claim 3, wherein said second configuration of said slider corresponds to an arrangement in which the slider is in a forward position following to an external mechanical actuation by an operator when electric power is not available, with a consequent deformation of the spring that is constituted by a reduction of an angle between the spring arms.

5. The lock of claim 3, wherein said worm screw has a first end that is keyed to said motor shaft, and a second, opposite end resting on said fixed seat.

6. The lock of claim 1, comprising a bit, arranged below the slider and movable from a first configuration, in which an inclined protruding surface thereof is arranged laterally to said slider, to a second configuration, in which said inclined surface rests on a lower surface of said slider, located in an upward position with said roller within said notches.

7. The lock of claim 6, wherein said bit is adapted to be rotated by an operator by way of an appropriately provided key.

8. The lock of claim 2, wherein said spring has a first arm end that is fixed to the body of the lock, a central portion that is engaged on said slider, and an opposite second arm end that is accommodated between two successive crests of said worm screw.

9. The lock of claim 8, wherein said spring has two long linear arms, which protrude from said central portion that is wound in a spiral shaped like a hollow cylinder.

10. The lock of claim 9, wherein said slider is provided with a protruding pin that accommodates said central portion of the spring.

11. The lock of claim 1, adapted to operate upon activation of a power supply of said electric motor.

* * * * *